United States Patent [19]

Fernandez

[11] 4,086,943

[45] May 2, 1978

[54] VALVE FOR FILLING BOTTLES WITH PRESSURIZED DRINKS

[75] Inventor: Juan Manuel Fernandez, Buenos Aires, Argentina

[73] Assignee: Val-Marco S.A.I.C., Buenos Aires, Argentina

[21] Appl. No.: 721,544

[22] Filed: Sep. 8, 1976

[30] Foreign Application Priority Data

| | | |
|---|---|---|
| Sep. 16, 1975 | Argentina | 260398 |
| Jan. 30, 1976 | Argentina | 262095 |

[51] Int. Cl.[2] ..... B67C 3/06

[52] U.S. Cl. ..... 141/39; 141/302

[58] Field of Search ..... 141/39, 40, 44, 46, 141/54, 56, 57, 198, 301, 302, 308, 309, 310, 392

[56] References Cited

U.S. PATENT DOCUMENTS 3,500,880 3/1970 Meyer ..... 141/40

*Primary Examiner*—Richard E. Aegerter
*Assistant Examiner*—Frederick R. Schmidt
*Attorney, Agent, or Firm*—Emory L. Groff, Jr.

[57] ABSTRACT

A back pressure filling valve for bottles comprises a central ventilation tube slidably mounted within a valve body member with clearance therebetween to provide an auxiliary passage for the air or gas. A frusto-conical check valve of elastomeric material controls this passage. A liquid control valve is mounted between an outer cylindrical body member and the valve body member and comprises a diaphragm of elastomeric material mounted on the outer cylindrical body member and having a central opening engaging the valve body member.

3 Claims, 10 Drawing Figures

VALVE FOR FILLING BOTTLES WITH PRESSURIZED DRINKS

The object of this invention is to provide an improved valve for filling bottles with pressurized drinks. It is particularly related to a valve of the type in which a plurality of valves is fixedly installed at the lower edge in the bottom of a tank wherein there is a drink and a gas which can be air, carbon dioxide, etc., under pressure.

Among the objects and scope of this invention are the provision of valve structure for the inlet of liquid to the bottle being filled. In order to have a fast and efficient filling of the bottle, it is necessary to have a large passage for the flow of liquid. In order to accomplish this, a novel inlet valve has been devised, comprising a diaphragm supported at its outer circumference and having an open center and which takes a frusto-conical shape when open, to provide a large open unimpeded path for the flow of filling liquid. This valve also lends itself to quick and efficient closing when the pressures are equalized in the operation of the filling device.

Another object is the provision of an auxiliary path of flow for the air or gas entering the bottle during the filling operation. This reduces the time necessary to charge the bottle with air or gas and thus reduces the filling time. A check valve is provided in this auxiliary path to close it when the air or gas is being ventilated when the liquid is entering the bottle, in order to accomplish a smooth and proper cut off of the filling at the desired liquid level.

Another object is to provide a simple, economical and dependable valve elements made of elastomeric material for use in back pressure filling valves.

Other objects and advantages of the present invention will appear in the course of the detailed description of the invention appearing hereinafter.

In order to more clearly explain the nature of this invention and the manner in which it can be carried on, the invention will be described below making reference to the accompanying drawings as regarding a preferred embodiment of the invention. Said preferred embodiment is shown merely as an exemplification, not limitative in any way of the scope of the invention, as defined above.

In the accompanying drawings, in which the same reference numerals correspond to the same parts, there is illustrated in diametral section, the valve according to this invention in several positions of operation, wherein.

Figures 1, 4:
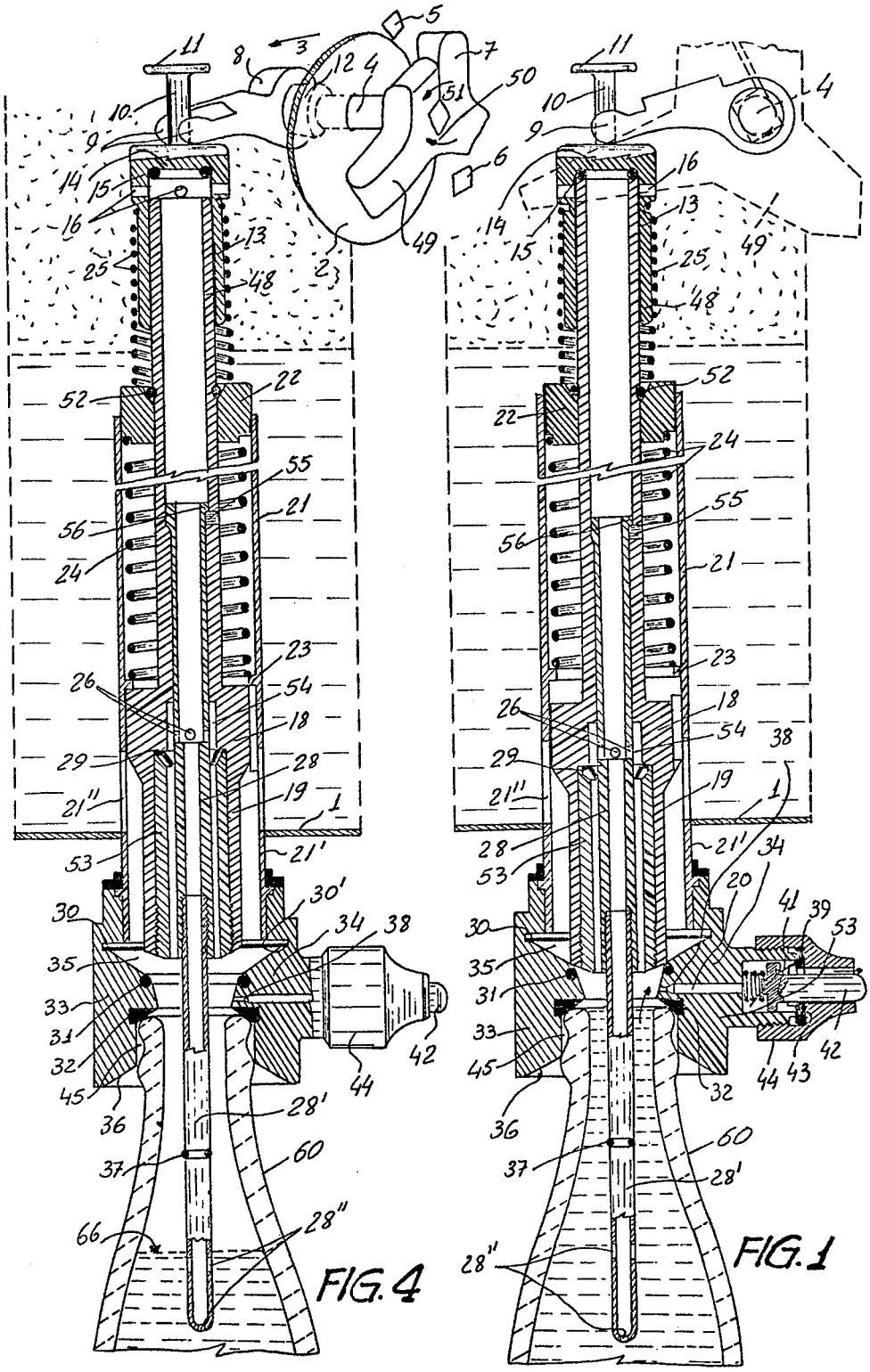
FIG. 1 shows, in a first embodiment, the valve at the end of filling a bottle.
FIG. 4 shows the valve at the end of the cycle, with the bottle filled up.

In the embodiment illustrated in FIGS. 1 to 6, and as can be noted in FIG. 4, the valve of the invention is shown installed in a tank having a bottle 1 and a cylindrical wall 2 (only a small portion of said lateral wall is shown in FIG. 4). The tank 1–2 is airtight and within it there is a drink and a gas under pressure.

Through wall 2 an axle 4 is passed which, outside tank 1–2, has a star 49 which, when tank 1–2 rotates in the direction shown by arrow 3, abuts with its arms against fixed stops, such as the one shown with numeral 5 for opening, rotating star 49 according to arrow 50, and stop 6, located forwardly, shown in spotted lines, rotating star 49 according to arrow 51. When the star rotates, the axle 4, passing through bushing 12, welded within tank 1–2, forces arm 8 located within tank 1–2, in the atmosphere of gas under pressure, to rise or drop, movement which is accompanied by fork 9, straddling a shank 10, which in its top portion has an upper stop 11 and which, in its lower end, is rigid with the end 14 of a thimble 13. Within thimble 13 there is, against the end 14, an annular packing 15 beneath which there are orifices 16. Surrounding thimble 13 there is a small coil spring 25, the lower end of which bears against a ring 22, located in the upper end of a fixed tubular casing element 21, the lower end of which (21′) exits out of tank 1–2 through the bottom 1.

The ring 22 is of a slightly less outer diameter than the inner diameter of tube 21 to slide thereon, and bears against the upper end of a large coil spring 24, the lower end of which bears against an annular inner projection 23 in the tube 21. The smaller 25 and larger 24 springs are coaxial to tube 21.

Beneath the inner projection 23 of the tube 21, there is a cylindrical valve body 18 slidable within tube 21, and having an upper tubular portion 48 and a lower tubular portion 19. Ring 22 is mounted on the upper tubular portion 48 and held from upward movement with respect thereto by the ring seal member 52. A supplementary tube 53 is rigidly mounted in lower tubular portion 19. An elastomeric frustroconical check valve 29 is secured on the body 18. Within the upper tube 48, cylindrical body 18 and lower tube 19, there is coaxially arranged a ventilation tube 28, the upper end of which has an outer diameter slightly smaller than the inner diameter of the upper tube 48, so that it can slide vertically therein, but cannot slide out downwardly because stop 55 will engage the projection 56 of the upper end of the ventilation tube 28. In its middle portion has lateral orifices 26 above check valve 29, and in the lower portion has orifices 28″ located in the lower end of the small tube 28′ which is an extension of ventilation tube 28.

The lower end of the supplementary tube 53 and the lower tube 19 are paired and face a ring-seal 31 located on an annular inner projection 34, in the middle portion of an annular cylindrical body member 33, rigid with the lower end 21′ of tube 21, emerging from tank 1–2 just below a lateral opening 21″ which said tube 21 has above the bottom 1 of tank 1–2. Above the ring-seal 31, the annular body 33 has a frustroconical recess 35, above which there is located an annular diaphragm valve member 30 partially housed in an annular groove 30′, of said annular body 33, a central hole of the diaphragm being of substantially equal diameter to the outer diameter of the lower end of lower tube 19. Beneath the annular inner projection 34 of the annular body 33, there is fixed an annular seal 32 and beneath thereof is extended a cylindrical chamber 45, which opens into a chamfering 36, which serves for channelling the upper edge of the bottle neck towards said circular chamber 45.

A small bore 38, which exits from the inner annular projection 34, is extended into a tube 20 which opens into a chamber 39, having a spring 40 and a piston 41 extended to form a button 42. The chamber 39 is closed by a cover 44 with a packing 43 being interposed. It is obvious that when the button 42 is pressed, it communicates the bore 38 with the atmosphere, since between said button 42 and the cover 44 there is a clearance 53' which is uncovered when the piston 41 is separated from the packing 43.

The operation of the embodiment illustrated in FIGS. 1 to 6, is the following: FIG. 1, shows the valve when the bottle 60 is about to be filled. A shutoff stop 6 forces star 49 to rotate in the direction of the arrow 51 and the fork depresses thimble 13 until the bottom 14 thereof presses packing 15 against the upper edge of tube 48, closing orifices 16 and preventing the exit of pressurized gas from tank 1–2, before continuing depression of upper tube 48, so that the lower end of lower tube 19 bears against ring-seal 31, closing to prevent the outgoing of the drink via lateral opening 21'' and frustroconical recess 35. As neither the gas nor the liquid can exit from tank 1–2, the button 42 of the cover 44 can then be depressed, letting the pressure escape from bottle 60 and the latter can be withdrawn.

Figure 2:
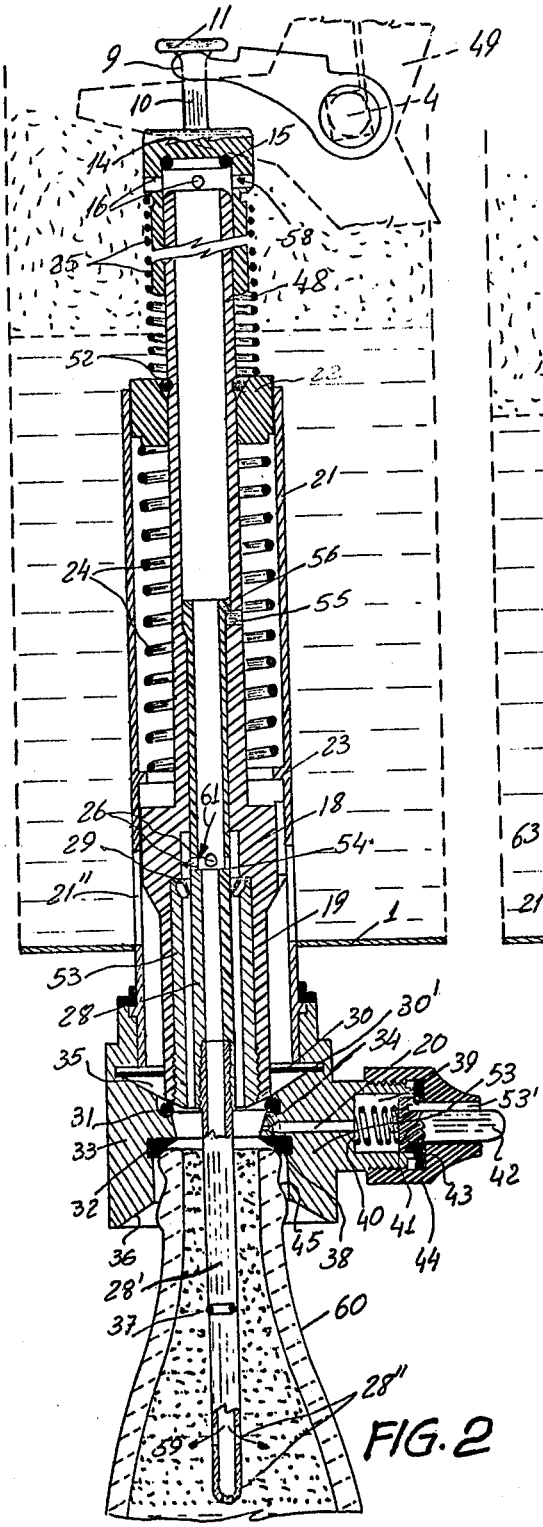
FIG. 2 shows the valve when filling an empty bottle with gas.
Figure 3:
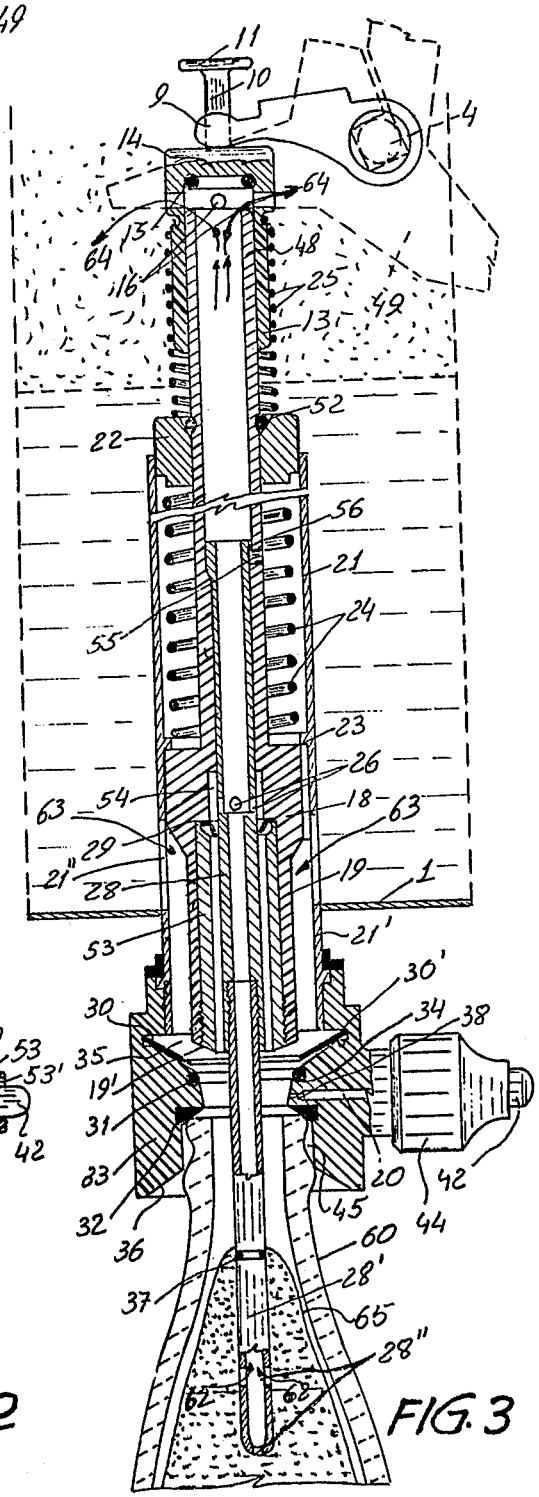
FIG. 3 shows the valve beginning to fill the bottle with drink.

When a new bottle 60, as shown in FIG. 2, is incoming, a stop 5 rotates star 49 in the direction of arrow 50, which makes the fork 9 rise, opening orifices 16 open. The gas then follows the path shown by arrows 58 and 59 and also by arrows 61 (FIG. 2) until, within bottle 60, the pressure is equalized with the pressure of gas in the tank 1–2. The gas can not exit by the lateral opening 21'' as the pressure of the liquid there is equal to that of gas plus the liquid column and, moreover, the ring-seal 31 is engaged by the end 19' of tube 19. The pressure of the spring 24 within the fixed vertical tube 21, raises then the slidable ring 22, counteracted by the pressure within the tank 1–2, and the end 19' of the inner tube 19 is also raised also above ring-seal 31. The pressure of the liquid (gas plus liquid column) then overrides diaphragm 30, as shown in FIG. 3 and the liquid enters (arrow 63) bottle 60 from which simultaneously (arrow 62) the gas exits through lower ventilation tube portion 28 and upper tube portion 48 and orifices 16, as shown by arrow 64. On the small tube 28' there is a ring-seal 37 which forces the liquid to pass towards the inner walls of bottle 60, following curve 65, as shown in FIG. 3. When the liquid reaches level 66 (FIG. 4), it blocks the orifices 28'' of tube 28' preventing the return of air towards tank 1–2, which makes a pressure higher than that of the gas to prevail in the inner space of bottle 60 and annular body 33, which straightens diaphragm 30 and closes it, together with valve 29, so the flow of liquid and gas is stopped, as shown in FIG. 4. The bottle can then be withdrawn, previously pressing relief button 42, so we go back to the position of FIG. 1. Star 49 will then be rotated to the position shown in FIG. 1.

Figure 5:
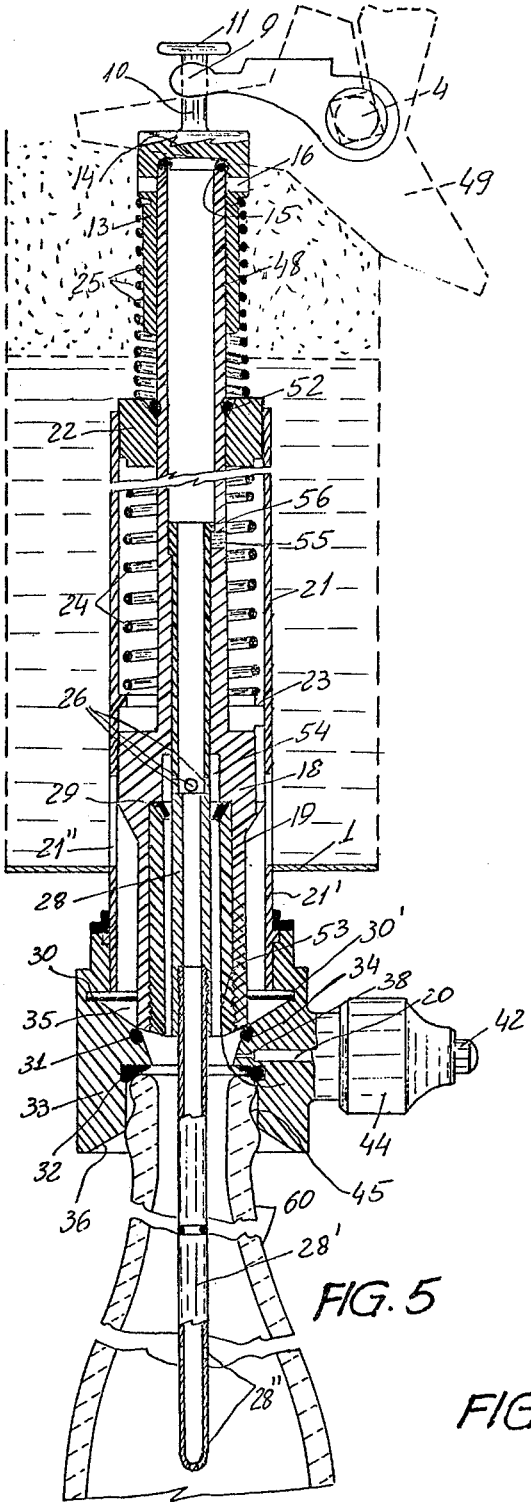
FIG. 5 shows the valve when a bottle is broken while being filled.

If, during the filling stage, as shown in FIG. 5, a bottle 60 is broken, the pressure makes lower tube 19 to descend, pressing ring-seal 31 and closing the exit of liquid.

Figure 6:
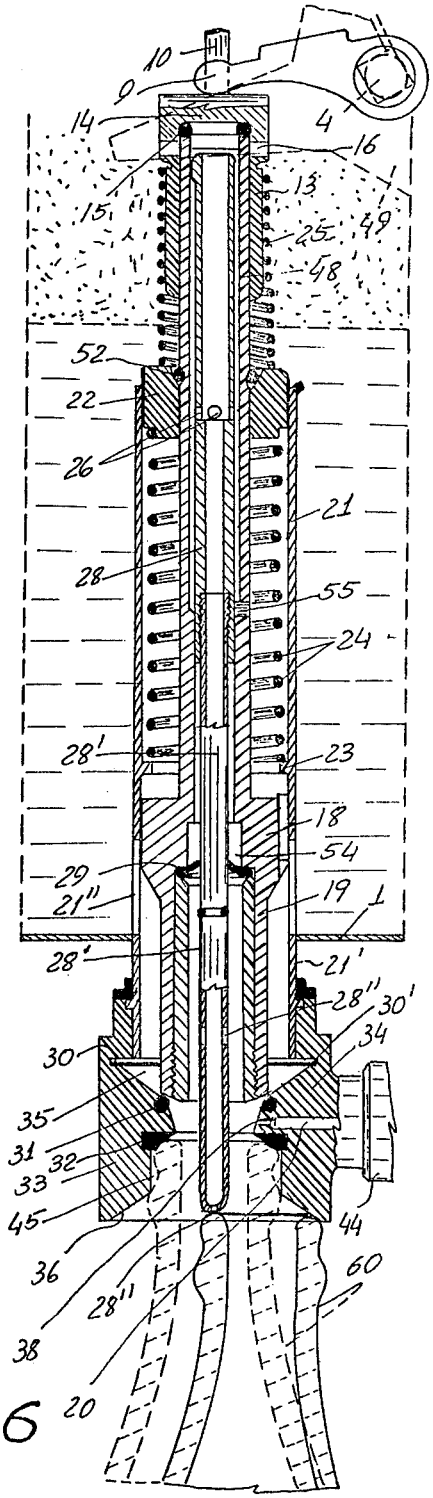
FIG. 6 shows the valve when an off-centered bottle is received.

If, when bottle 60 is raised (by means which are not part of the invention), the bottle, because of being off-centered would bear on small tube 28', the latter would be displaced upwardly as shown in FIG. 6. When the bottle becomes centered, by means of chamfer 36, the small tube 28' will fall again into bottle 60, up to the extent permitted by projection 56 and stop 55, restablishing normal conditions.

In another preferred embodiment, the valve, as shown in FIGS. 7 to 10, has mounted on the tubular portion 19 of member 18, a different form of check valve, comprising an elastomeric body **29*a* having its upper portion interlocked at 29*b* with tubular portion 19, and having a frusto-conical portion 29*c* at its lower end adapted to engage the ventilation tube 28. This check valve will control passage of fluid through orifices 26*a*, as in FIG. 1**.

The operation in this embodiment is carried on according to the sequence illustrated in FIGS. 7 to 10, in the manner detailed below.

Figure 7:
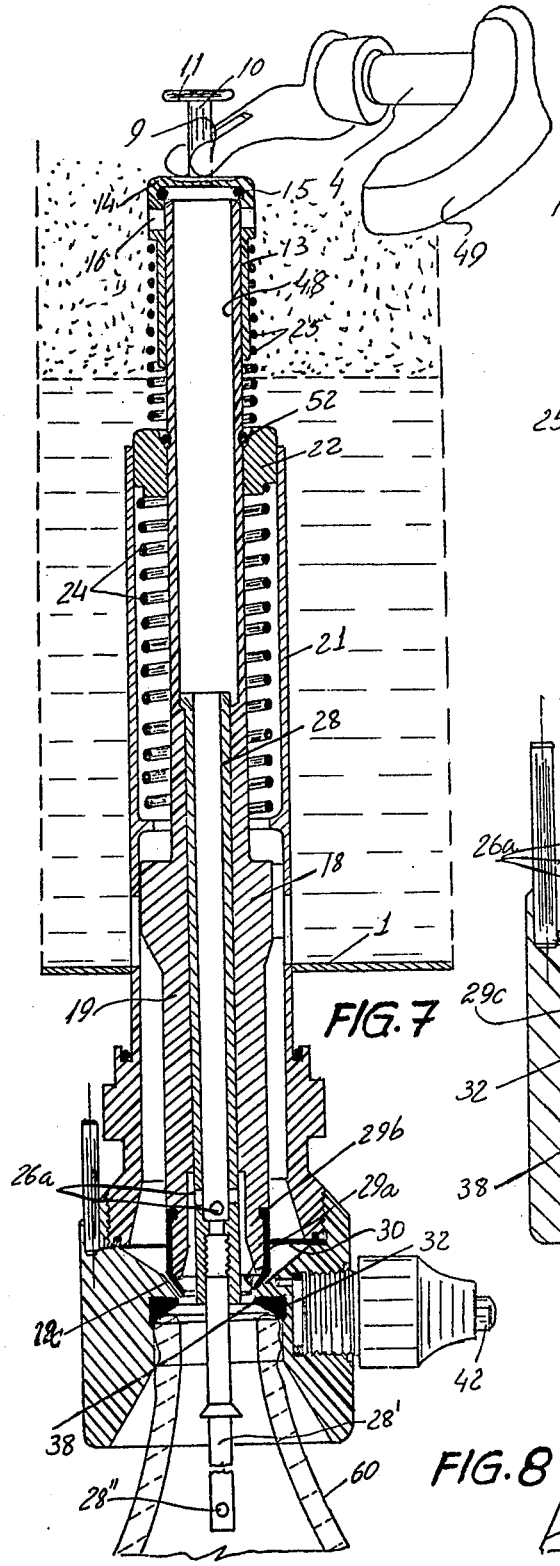
FIG. 7 represents a longitudinal section in a second embodiment of the present improved valve.
Figure 8:
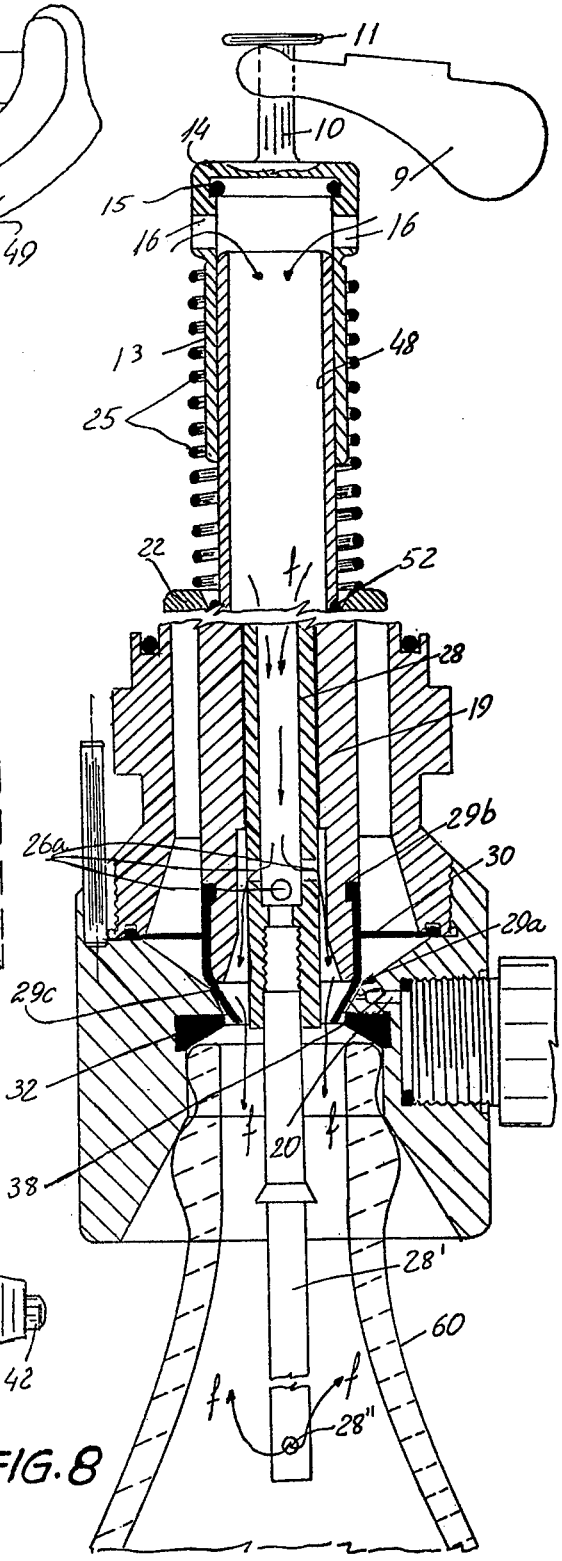
FIG. 8 is an enlarged similarly fragmented section of FIG. 7, in the initial stage of filling, wherein the present improvements are shown in enlarged detail, and finally
Figure 9:
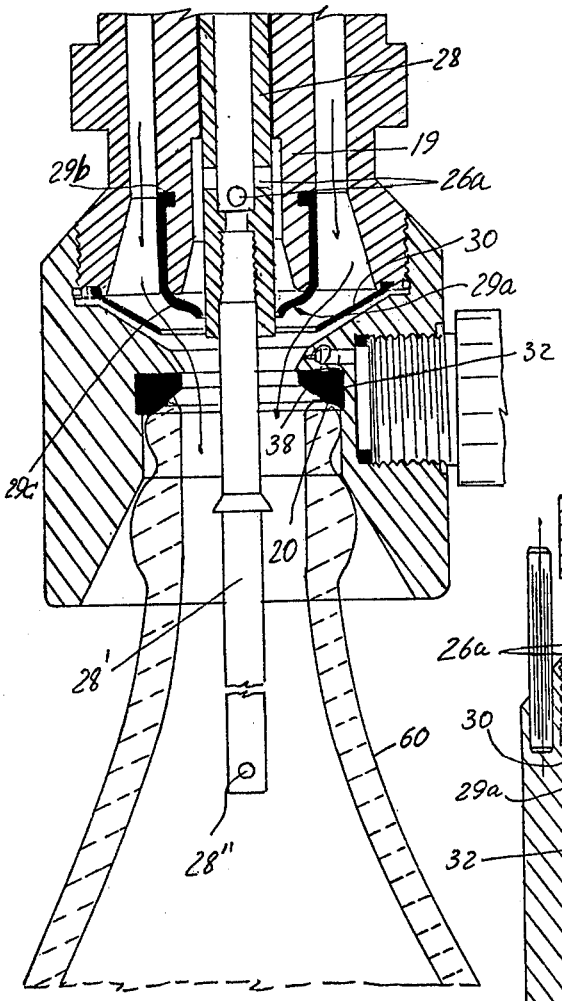
FIGS. 9 and 10 show in a sequential manner the two phases of filling with liquid by means of the valve shown in FIGS. 7 and 8.
Figure 10:
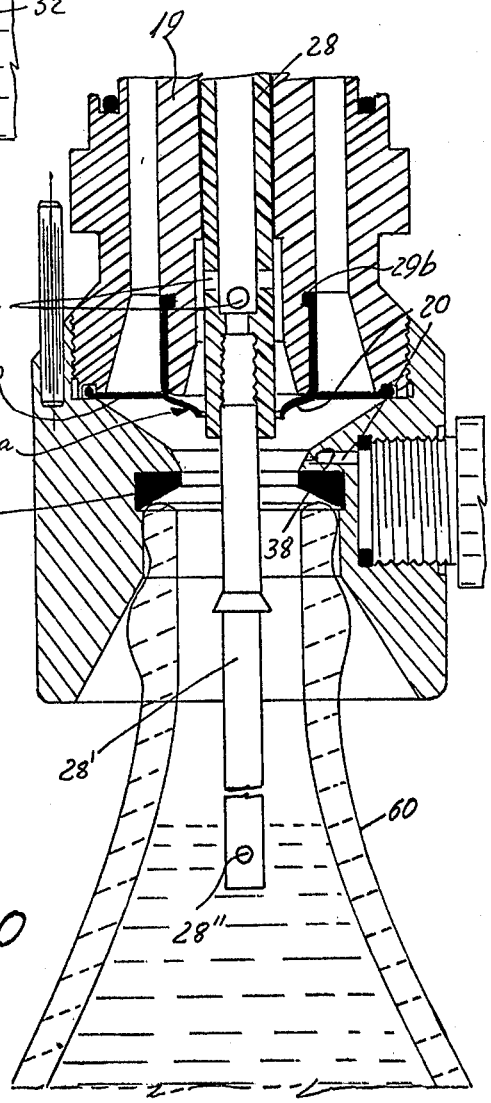

In FIG. 7 there is shown a bottle 60 with a mouth for a crown or threaded cap, vertically aligned beneath the filling valve and appropriately pressed against annular seal 32.

When the tank rotates, the star 49, by the action of a stop, is forced to rotate, actuating fork 9 until the thimble 13 is raised, with the opening of orifices 16, letting pressurized gas pass from the tank.

From this moment, the filling process is started. The pressurized gas or air, located above the liquid, within the tank, goes through orifices 16 to penetrate in the upper tube 48 and then into the ventilation tube 28, to go out by orifices 28'', and then into bottle 60, as shown by arrow F, in FIG. 8.

Additionally, air or gas finds another way toward the bottle 60 namely by orifices **26*a*, in the retractable ventilation tube 28, the check valve 29*a* secured at 29*b* to tower tubular member 19, and into bottle 60**.

When the pressure inside the bottle 60 reaches the level of that inside the tank, the spring 24 bearing on fixed vertical tube 21, presses the ring 22 and the ring-seal 52, and valve body member 18 upwardly, causing the displacement of body 18, raising with this the seal **29*a***, permitting the passage of liquid.

The force of the liquid jet going through the filling valve to the bottle, makes diaphragm 30 to collapse (FIG. 9) against the cone thereunder, with the cone serving as a funnel.

In this manner, a great section is open, through which the liquid passes at a high flow rate.

While the liquid goes down into the bottle 60 by the walls thereof, the air or gas contained therein returns to the tank of the filling machine by the orifices 28'', the ventilation tube of 28, the tube of the body 48 and through orifices 16 of the thimble 13.

The air or gas cannot return by the parallel route formed by orifices **26*a* and check valve 29*a***, since this check valve, the pressure being equal, returns, by its own resiliency to the initial position, closing the route.

When the liquid level within the bottle 60 covers the orifices 28'' (FIG. 10) the return of the gas into the tank is interrupted and the pressure increases rapidly until a momentaneous state of equilibrium occurs, because, due to the equivalence between the air or gas pressure above the level within the bottle, and the gas pressure within the tank plus the weight of the liquid column therein, there is no force to maintain the diaphragm 30 in its collapsed position and therefore it returns to its initial state (FIG. 7) due to its inherent resiliency, serving as a seal by its engagement with check valve body 29*a*.

At this time, thimble 13 will be moved downwardly by the fork 9, closing orifices 16 and closing portion 29*c* of valve 29*a* against its seat on the annular cylindrical body member 33, thus closing the back pressure and liquid flow passages. Then, a mechanical pressure on button 42 produces the opening of the relief valve communicating the inside of the bottle with the atmosphere, discharging compressed air or gas within the bottle through orifice 38 until the atmosphere pressure is equilibrated.

With this operation, the filling of the bottle is concluded, and the only task to be effected is the labelling thereof and its subsequent withdrawal, which are carried on by means arranged in combination with the filling machine.

The advantages of this embodiment consist in that the backpressure valve 29*a* serves as a seal to prevent the return of the gas or air towards the tank during the filling, by taking a path upwardly outside of tube 28 and through orifices 26*a*. The gas or air must return through tube 28 to maintain control of the fill level.

Furthermore, in the prior art during the backpressure period, first phase of the filling operation, the gas in the tank normally goes down the ventilation tube 28 by a single route, into the bottle 60.

This implies that the inner diameter of the tube 28 is the one which determines the rate of equalizing the pressures between the tank and the bottle.

With the lateral orifices 26*a* and the annular frusto-conical portion 29*c* serving as a check valve, a secondary passage for backpressure is open. This parallelism of pneumatic routes permits that the time for equilibrating the pressure between tank and bottle is shortened and therefore the filling time for each bottle is reduced, which is one of the most important advantages afforded by the present improvements and, finally due to the check valve 26, the return of the gas to the tank is effected only through the ventilation tube 28, which is the sole regulator of the filling level.

The invention, in the manner just expressed, is self-evident and does not require further explanation for those who are expert in the art It is obvious that modifications in construction and detail can be introduced, without thereby departing from the scope of the invention, which is clearly determined in the following claims.

Having so particularly described and determined the nature of the present invention and the manner by which it can be put in practice, it is expressed that what is claimed as exclusive property and invention is set forth as follows:

What is claimed is:

1. In a back pressure filling valve for bottles designed for containing pressurized drinks, wherein the bottles are filled from a tank having a bottom wall and containing a liquid and a gas under pressure, comprising, a tubular casing element fixed to and extending through the bottom wall of said tank and having openings within the tank for the passage of liquid, a valve body member having a cylindrical portion slidably mounted in said tubular casing element and having uppper and lower tubular portions extending above and below said cylindrical portion, respectively, a ventilation tube slidably mounted in said upper tubular portion and extending below said lower tubular portion, the inner wall of said lower tubular portion being of greater diameter than that of the ventilation tube, providing an annular cavity therebetween, an elastomeric check valve mounted on said valve body member and having a frusto-conical portion engageable with said ventilation tube, an annular cylindrical body member mounted on the lower end of said tubular casing, a diaphragm valve member mounted at its outer circumference on said annular cylindrical body member and having a central concentric opening slidably engaging the lower tubular portion of the valve body member, said annular cylindrical body member having a frusto-conical surface beneath said diaphragm valve member and engageable thereby in the open position of said valve member, said ventilation tube having orifices above said elastomeric check valve whereby said check valve controls fluid flow through said orifices.

2. In a back pressure filling valve as recited in claim 1, a suplementary tube rigidly fitted within the lower tubular portion of said valve body member and engaging the outer circumference of said elastomeric check valve member to secure it in place in said annular cavity.

3. In a back pressure filling valve as recited in claim 1, said elastomeric check valve member having a tubular portion secured to and surrounding the lower tubular portion of said valve body member and extending therebelow, and an inwardly extending frusto-conical portion on said valve member adapted to engage said ventilation tube.

* * * * *